US005805141A

United States Patent [19]

Hsu

[11] Patent Number: 5,805,141

[45] Date of Patent: Sep. 8, 1998

[54] JOYSTICK DIRECTION CONTROL MEANS

[75] Inventor: Fan-yi Hsu, Hsintien, Taiwan

[73] Assignee: Anko Electronic Co., Ltd., Taipei Hsien, Taiwan

[21] Appl. No.: 865,193

[22] Filed: May 29, 1997

[51] Int. Cl.[6] ..... G09G 5/08

[52] U.S. Cl. ..... 345/161; 345/156; 345/157; 74/174; 463/38; 273/148 B

[58] Field of Search ..... 345/161, 156, 345/157; 250/64; 74/471; 338/128, 129, 134; 463/38; 273/148 B

[56] References Cited

U.S. PATENT DOCUMENTS 4,156,130 5/1979 Ivashin et al. ..... 338/128
4,587,510 5/1986 Kim ..... 338/128

*Primary Examiner*—Jeffery A. Hofsass
*Assistant Examiner*—Julie B. Lieu
*Attorney, Agent, or Firm*—Beveridge, DeGrandi, Weilacher & Young, LLP

[57] ABSTRACT

A joystick direction control means mainly including a variable resistance, a mounting seat assembled onto a resistance adjusting rod of the variable resistance and being fixed thereto by lugs projecting from the variable resistance and engaging with four comers of the mounting seat, and a mounting board assembled to the mounting seat by extending a central shaft of the mounting seat and two retaining wings at two sides of the central shaft through a receiving hole on the mounting board and turning the mounting board about the central shaft by 90 degrees, so that the whole joystick direction control means can be quickly assembled with the mounting board properly tightened to the mounting seat.

6 Claims, 7 Drawing Sheets

JOYSTICK DIRECTION CONTROL MEANS

FIELD OF THE INVENTION

The present invention relates to a joystick direction control means, and more particularly to a joystick direction control means which can be easily and quickly assembled from a few components and allows proper tightness relation between the components for smooth and sensitive operation and correction of a joystick connected thereto.

Due to fewer components are needed to form the means, the means requires lower mold and manufacturing costs.

BACKGROUND OF THE INVENTION

The quick development of multi-media video equipments has stimulated the prosperous growth of related industries and peripheral equipments, such as the joystick used in TV game machines. Many manufacturers engage in the development of newer and stronger joystick structure that can be more easily operated and has higher sensitivity.

FIGS. 7 and 8 illustrate a conventional direction control means mounted in a joystick seat. The means includes a variable resistance 10 having a resistance adjusting rod 101 projecting from one flat plane thereof and four lugs 102 projecting from the same plane, a mounting seat 11 having four inward arcuated corners 112 and two retaining blocks 111 symmetrically provided at two sides of the mounting seat 11, a correcting collar 12 having two retaining holes 121 formed at positions corresponding to the retaining blocks 111 of the mounting seat 11, and a mounting board 13 having a hollow shaft 131 for mounting onto the resistance adjusting rod 101 which sequentially extends through the mounting seat 11, the correcting collar 12 and the mounting board 13.The mounting seat 11 is fixed to the variable resistance 10 by engagement of the four arcuated corners 112 with the four lugs 102. The correcting collar 12 is fixed to the mounting seat 11 by engagement of the retaining holes 121 with the retaining blocks 111. After the resistance adjusting rod 101 extends through the mounting board 13, a washer 14 and a nut 15 are put around the rod 101 .to lock all the components together. The mounting board 13 is provided at three continuous edges with outward projected rails 132 for engaging into grooves formed on a mounting frame in the joystick seat, so that the whole assembled direction control means can be fixed in the joystick seat.

As mentioned above, the components of the means are locked together by tightening the washer 14 and the nut 15 to the resistance adjusting rod 101. However, since the mounting board 13, the correcting collar 12, and the mounting seat 11 and the retaining blocks 111 thereof are usually made of thermosetting plastic material, they tend to break when they are too tightly locked together. This will increase the bad yield rate of products and accordingly the manufacturing cost and therefore does not meet the industrial economical principle. On the other hand, the direction control means with overtightened components shall cause difficult turning of the correcting collar 12 at its projected handle due to an increased contact friction encountered by the collar 12. Meanwhile, the joystick shall be operated at reduced sensitivity. Reversely, in the event the components of the direction control means are not sufficiently locked together, the correcting collar 12 shall become too loose to perform accurate correction. It is therefore desirable to develop a joystick direction control means in which components can be more easily assembled to allow optimum tightness between them to enable perfect operation and correction of the joystick connected thereto.

SUMMARY OF THE INVENTION

A primary object of the present invention is to provide a joystick direction control means in which a mounting board can be rotatably connected to a mounting seat by extending two retaining wings of the mounting seat through a receiving hole on the mounting board and turning the mounting board by 90 degrees.

Another object of the present invention is to provide the above joystick direction control means in which the mounting seat is provided at two sides with two symmetrical locating blocks for a correcting collar to locate thereat. Then, connect the mounting board to the mounting seat by extending the two retaining wings of the mounting seat through the receiving hole on the mounting board and turning the mounting board by 90 degrees.

The joystick direction control means according to the present invention can be easily assembled while it allows the joystick to be operated or corrected in a smooth and sensitive manner. The joystick direction control means of the present invention has simple structure with only a few components and therefore requires reduced costs for making molds. And the assembling of the present invention can be easily and quickly completed without any hand tool.

BRIEF DESCRIPTION OF THE DRAWINGS

The structure and functions of the present invention can be best understood by referring to the following detailed description of the preferred embodiment and the accompanying drawings, wherein.

DETAILED DESCRIPTION OF THE PREFERRED EMBODIMENTS

Figure 1:
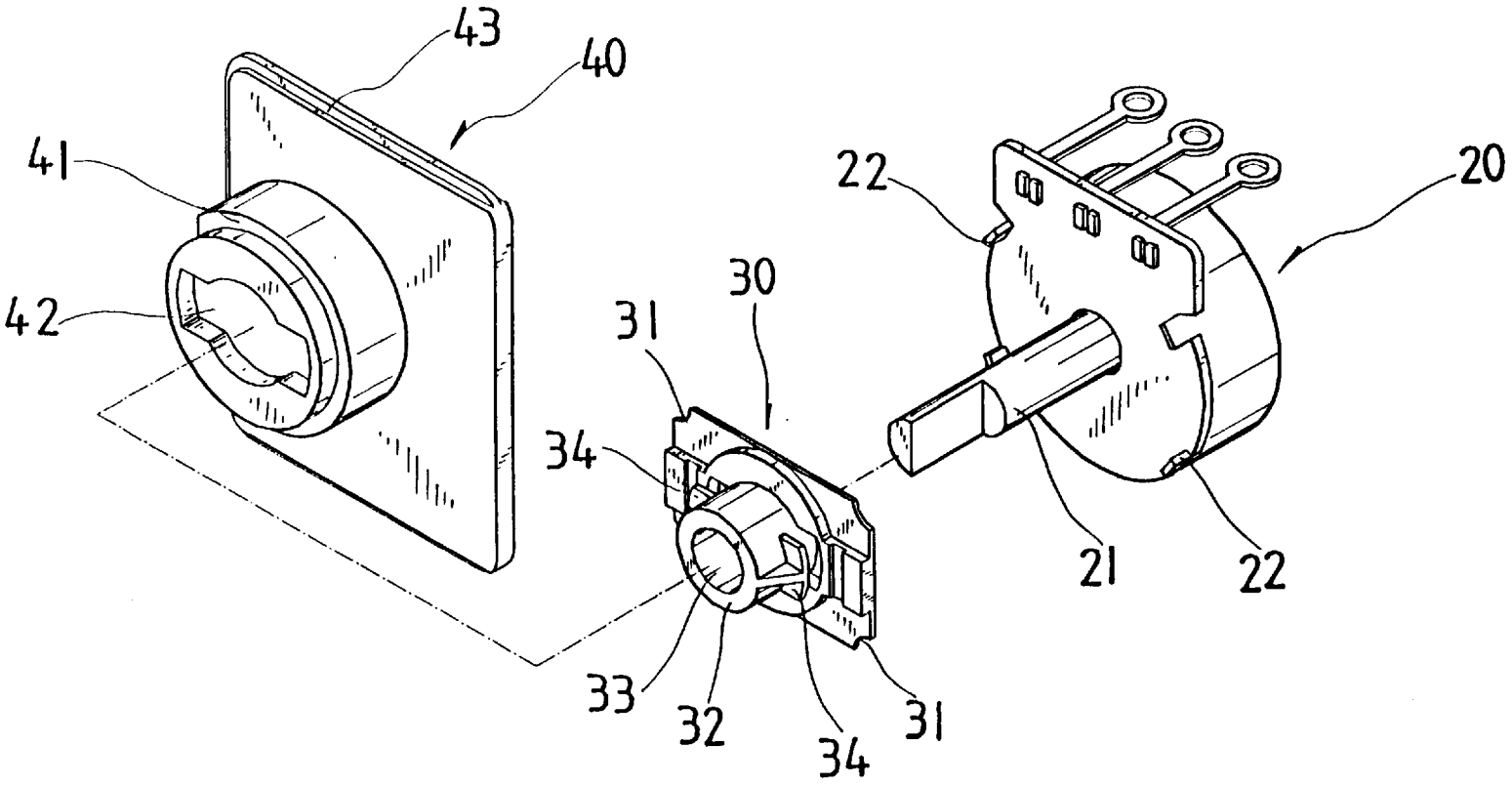
FIG. 1 is an exploded perspective of a first embodiment of the present invention.
Figure 2:
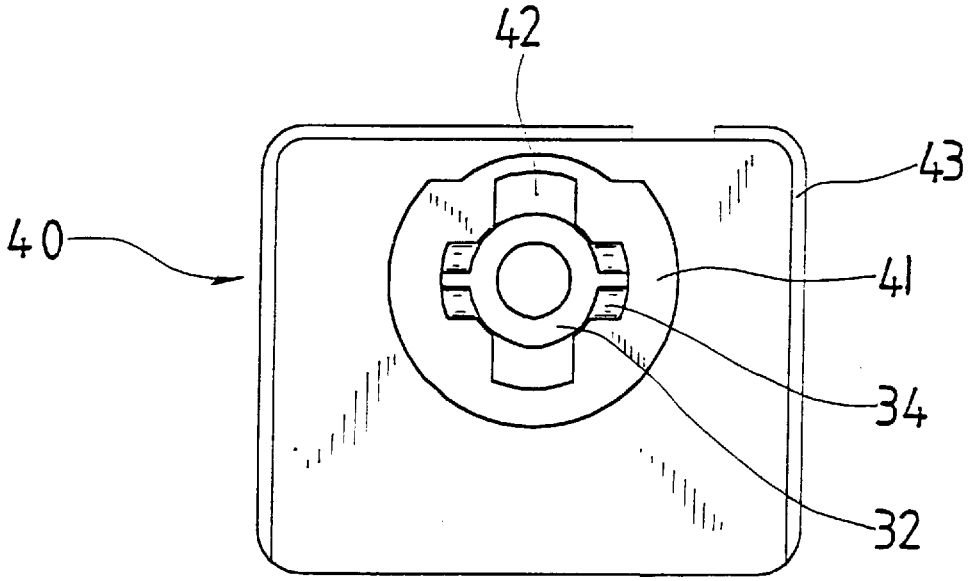
FIG. 2 is an assembled front view of the first embodiment of the present invention shown in FIG. 1.

Please refer to FIGS. 1 and 2 which respectively show an exploded and an assembled perspective of a joystick direction control means for mounting in a joystick seat 50 to generate signals about the joystick's angular displacement in X-axis and Y-axis directions. The joystick direction control means according to the present invention mainly includes a variable resistance 20, a mounting seat 30, and a mounting board 40.

The variable resistance 20 may be a conventional carbon variable resistance or an optical variable resistance. A substantially round resistance adjusting rod 21 projects from one flat side of the variable resistance 20. A free end of the resistance adjusting rod 21 is connected to a joystick via a universal coupler. From a periphery of the same side having the resistance adjusting rod 21, four lugs 22 espacedly extend in the same direction as that of the resistance adjusting rod 21.

The mounting seat 30 is a substantially rectangular base plate from one surface thereof a stepped hollow central shaft 32 having an axial through hole 33 perpendicularly projects in the same direction as that of the resistance adjusting rod 21 of the variable resistance 20. Four corners of the mounting seat 30 form inward arcuated dents 31 to fitly engage with the lugs 22 of the variable resistance 20. Two retaining wings 34 symmetrically project from two diametrically opposite sides of the stepped central shaft 32 toward two shorter edges of the rectangular mounting seat 30.

Figure 3:
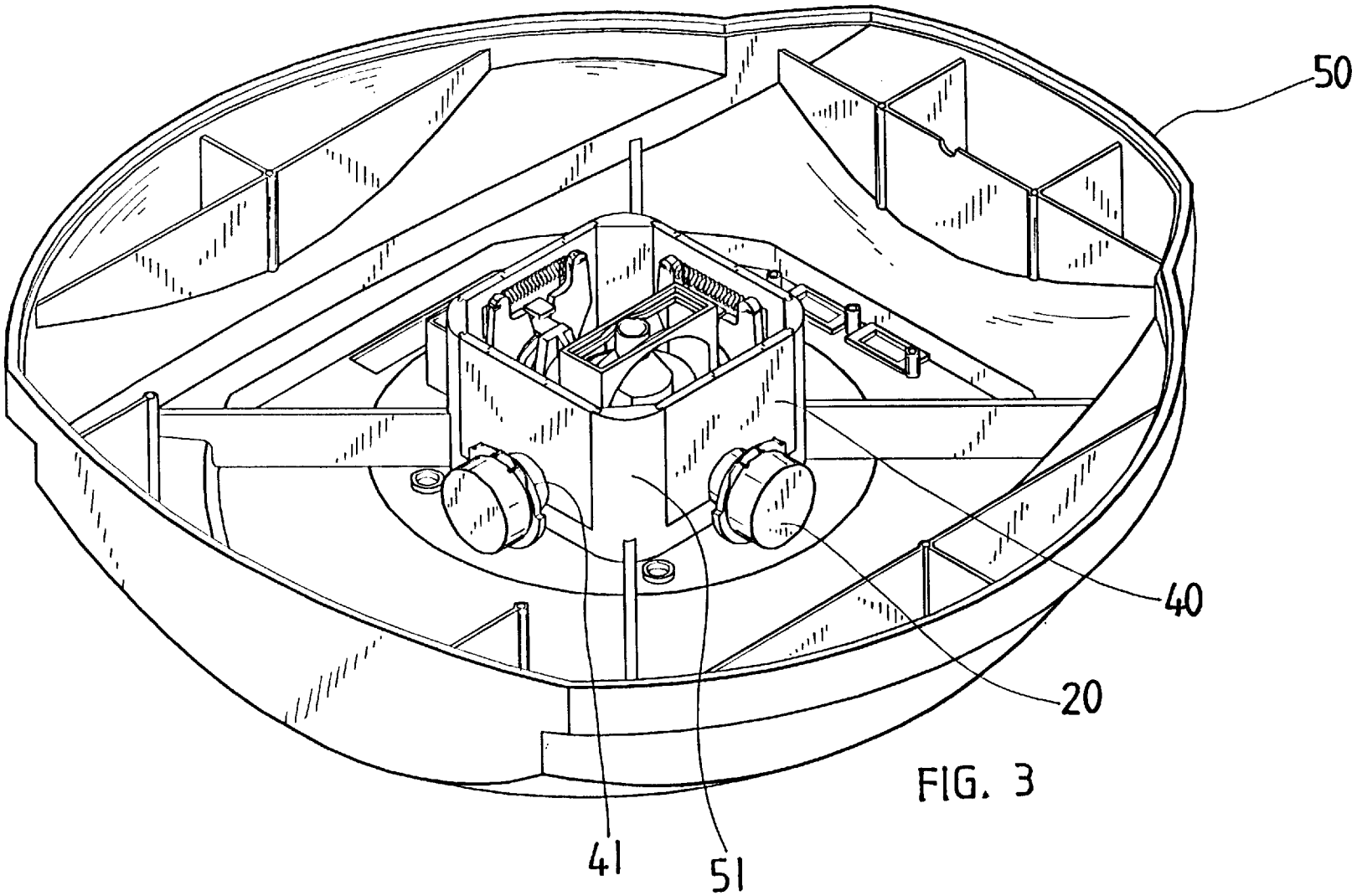
FIG. 3 is a perspective showing the first embodiment of the present invention being mounted to a joystick seat.

The mounting board 40 is also a substantially rectangular board having a stepped hollow shaft 41 projecting from one surface thereof to extend in the same direction as that of the stepped central shaft 32 of the mounting seat 30. The stepped hollow shaft 41 has a receiving hole 42 which has a shape suitable for the stepped central shaft 32 and the two retaining wings 34 of the mounting seat 30 to pass through. When the mounting seat 30 is assembled to the mounting board 40 with the stepped central shaft 32 and retaining wings 34 extending through the receiving hole 42, the mounting board 40 is allowed to rotate by 90 degrees so that it is retained between the retaining wings 34 and the mounting seat 30 itself. Three continuous outer peripheral edges of the mounting board 40 are provided with outward projected rails 43 for engaging into grooves 51 formed on a mounting frame of the joystick seat 50 as shown in FIG. 3.

Figure 5:
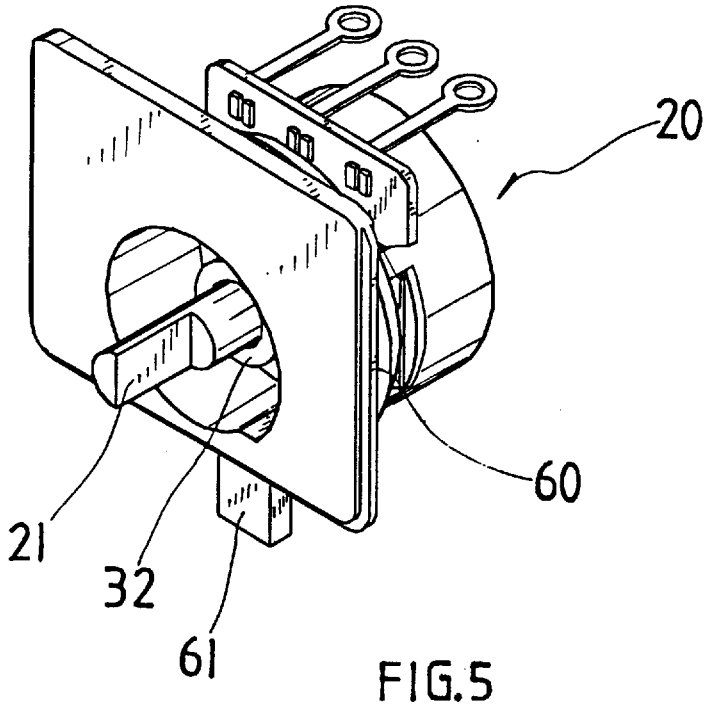
FIG. 5 is an assembled perspective of the second embodiment of the present invention shown in FIG. 4.
Figure 4:
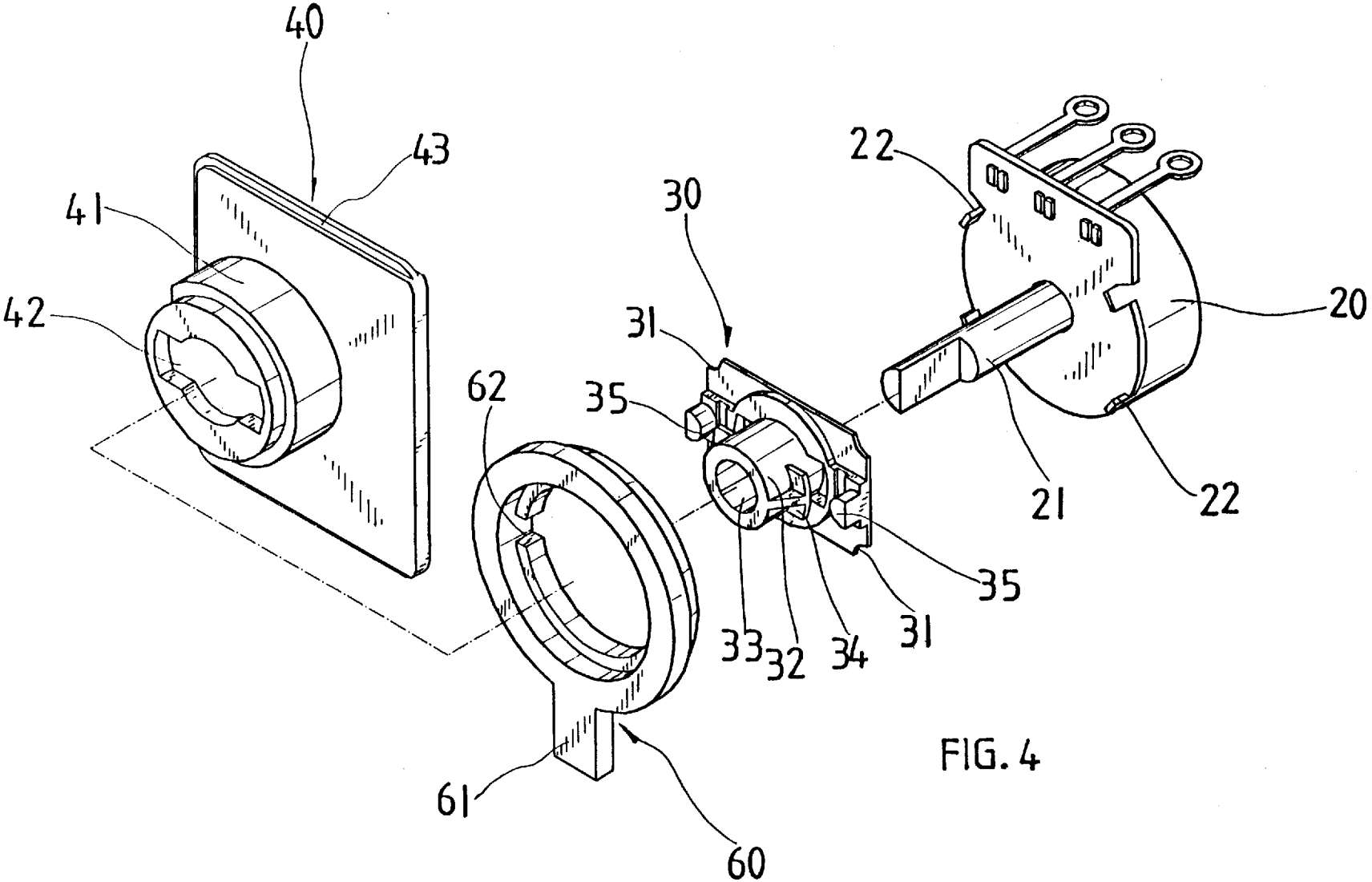
FIG. 4 is an exploded perspective of a second embodiment of the present invention.

When the present invention is to be mounted in the joystick seat 50 to serve as an adjusting button for accurately correcting the position of the joystick or to serve as an adjusting rod for other purposes, a correcting collar 60 can be added to the above described means, as shown in FIGS. 4 and 5. To mount the correcting collar 60, the mounting seat 30 is further provided adjacent to the two shorter edges with two locating blocks 35, so that each of the locating blocks 35 faces one of the retaining wings 34 with a vertical space left between a top of the locating blocks 35 and a bottom of the retaining wings 34. The correcting collar 60 is so formed that it has an outward projected adjusting bar 61 and a stepped inner wall. Two cuts 62 are spacedly provided on an inner wall portion of the correcting collar 60 that has reduced diameter. When the correcting collar 60 is assembled to the mounting seat 30, permit the two locating blocks 35 on the mounting seat 30 to engage into the two cuts 62 on the correcting collar 60. Then, assemble the mounting board 40 to the mounting seat 30 with the axial through hole 33 and the retaining wings 34 of the mounting seat 30 extending through the receiving hole 42 on the mounting board 40. Thereafter, the mounting board 40 is turned relative to the mounting seat 30 by 90 degrees to complete the assembling.

Figure 6A:
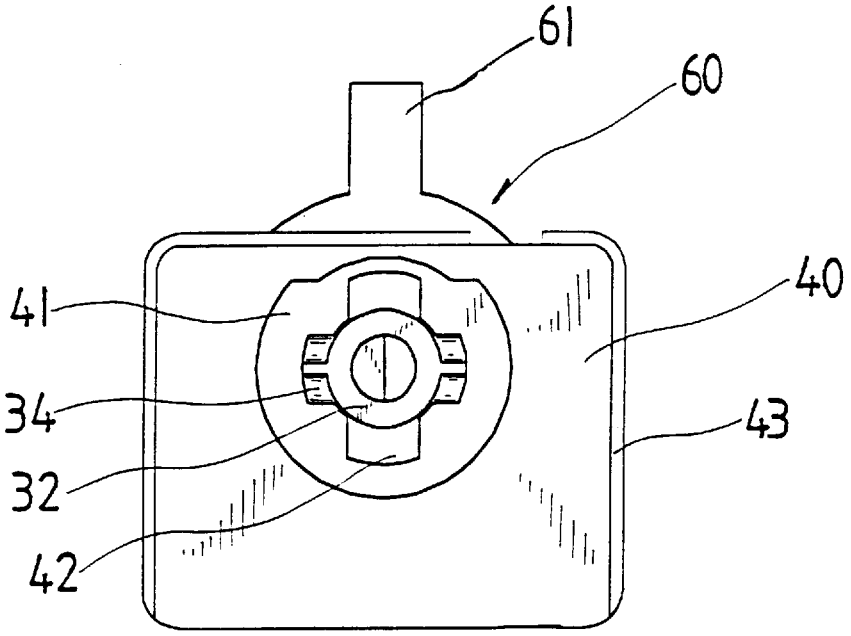
FIG. 6A illustrates manipulation of the second embodiment of the present invention, wherein an adjusting handle of the correction collar is located at a centered position.
Figure 6B:
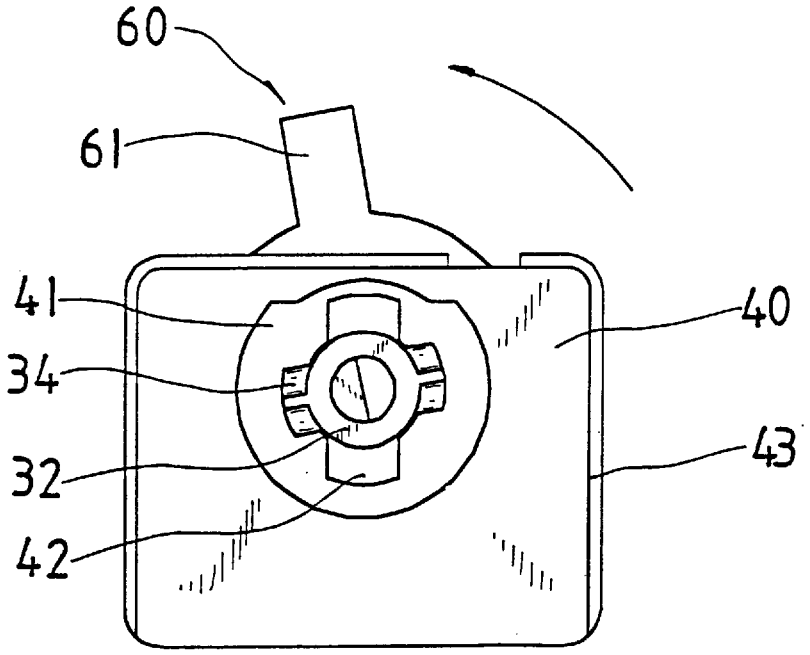
FIG. 6B is similar to FIG. 6A but the adjusting handle of the correction collar is shifted leftward.
Figure 7:
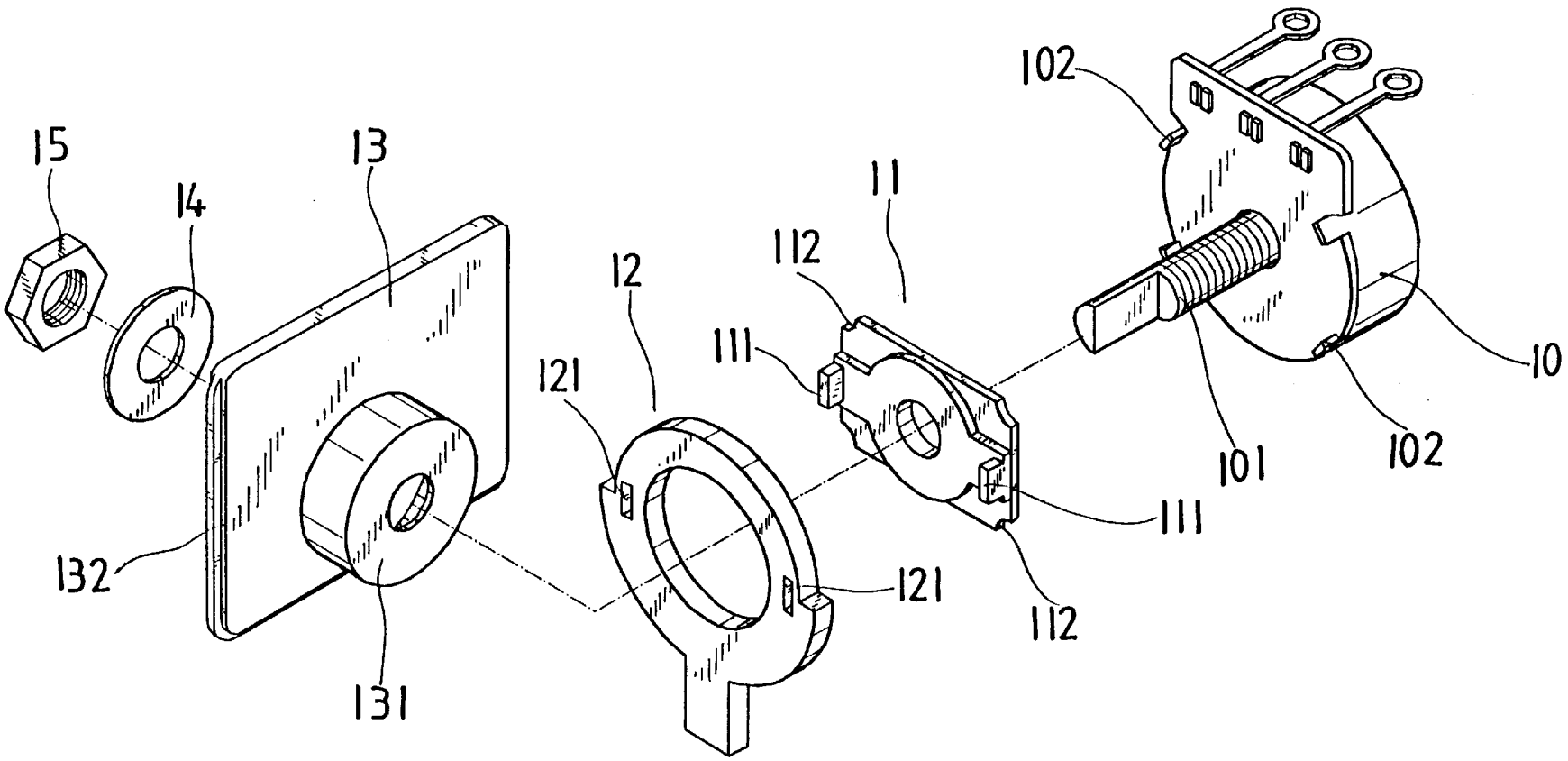
FIG. 7 PRIOR ART
FIG. 7 is an exploded perspective of a conventional joystick direction control means.
Figure 8:
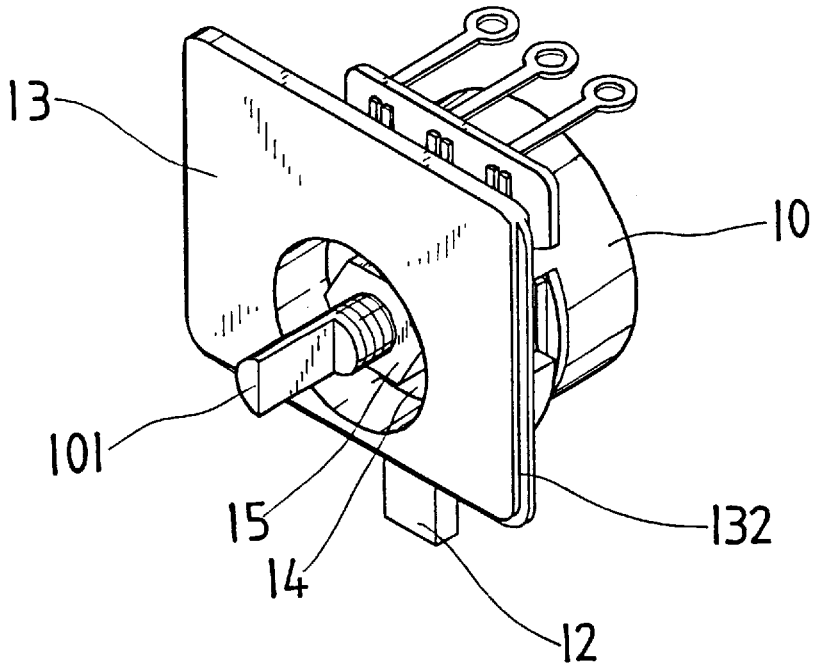
FIG 8 PRIOR ART
FIG. 8 is an assembled perspective of the joystick direction control means shown in FIG. 7.

As shown in FIGS. 6A and 6B, the mounting board 40 is rotatably assembled to the mounting seat 30. And, the vertical space left between the retaining wing 34 and the locating block 35 at two sides of the axial through hole 33 just allows a smooth contact of the mounting seat 30 with the mounting board 40 and of the correcting collar 60 with the mounting board 40, forming an ideal direction control means which is easily manipulable and highly sensitive in its operation for controlling a joystick direction or correcting a joystick position or other adjusting functions. Such direction control means is welcomed for use with many multi-media video equipments. In brief, the joystick direction control means according to the present invention can be easily assembled while it allows the joystick to be operated or corrected in a smooth and sensitive manner. The joystick direction control means of the present invention has simple structure with only a few components and therefore requires reduced costs for making molds. And the assembling of the present invention can be easily and quickly completed without any hand tool.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A joystick direction control means for mounting in a joystick seat to generate signals about a joystick's angular displacement in X-axis and Y-axis directions, to accurately adjust and correct the joystick's position, or to perform other adjusting functions, comprising:

a variable resistance being provided at one flat side with a forward projected resistance adjusting rod and four lugs extending from outer periphery of said flat side in the same direction as that of said resistance adjusting rod;

a mounting seat being assembled to said variable resistance and fixed thereto by said four lugs engaging with four comers of said mounting seat, said mounting seat having a hollow central shaft which has a stepped outer wall and two retaining wings symmetrically projecting from two diametrically opposite sides of said stepped outer wall of said hollow central shaft; and a mounting board having a hollow shaft which has a stepped outer wall and a receiving hole formed at a front surface of said hollow shaft, such that said mounting board is rotatably assembled to said mounting seat with said hollow central shaft and said retaining wings of said mounting seat extending through said receiving hole on said mounting board, whereby when said mounting board is turned relative to said mounting seat by a predetermined angle, said mounting board is fixed between said mounting seat and said retaining wings; and said mounting board being provided at three continuous edges with outward projected rails for engaging into grooves formed on a mounting frame in said joystick seat, so that said joystick direction control means is fixed to said joystick seat.

2. A joystick direction control means as claimed in claim 1, wherein said variable resistance is an optical variable resistance.

3. A joystick direction control means as claimed in claim 1, wherein said variable resistance is a carbon variable resistance.

4. A joystick direction control means for mounting in a joystick seat to generate signals about a joystick's angular displacement in X-axis and Y-axis directions, to accurately adjust and correct the joystick's position, or to perform other adjusting functions, comprising:

a variable resistance being provided at one flat side with a forward projected resistance adjusting rod and four lugs extending from outer periphery of said flat side in the same direction as that of said resistance adjusting rod;

a mounting seat being assembled to said variable resistance and fixed thereto by said four lugs engaging with four corners of said mounting seat, said mounting seat having a hollow central shaft which has a stepped outer wall and two retaining wings symmetrically projecting from two diametrically opposite sides of said stepped outer wall of said hollow central shaft, said mounting seat further having two locating blocks provided at two outer ends of said mounting seat such that said locating blocks are spaced from said retaining wings in axial and radial directions;

a correcting collar being provided on an outer periphery at a predetermined position with an outward projected adjusting bar and having stepped inner and outer walls, two cuts being spacedly and symmetrically provided on said stepped inner wall to engage with said two locating blocks on said mounting seat; and a mounting board having a hollow shaft which has a stepped outer wall and a receiving hole formed at a front surface of said hollow shaft, such that said mounting board is rotatably assembled to said mounting seat with said hollow central shaft and said retaining wings of said mounting seat extending through said receiving hole on said mounting board and with said correcting collar located between said mounting seat and said mounting board, whereby when said mounting board is turned relative to said mounting seat by a predetermined angle, said mounting board is fixed between said mounting seat and said retaining wings; and said mounting board being provided at three continuous edges with outward projected rails for engaging into grooves formed on a mounting frame in said joystick seat, so that said joystick direction control means is fixed to said joystick seat.

5. A joystick direction control means as claimed in claim 4, wherein said variable resistance is an optical variable resistance.

6. A joystick direction control means as claimed in claim 4, wherein said variable resistance is a carbon variable resistance.

* * * * *